US006230383B1

(12) United States Patent
Welleman et al.

(10) Patent No.: US 6,230,383 B1
(45) Date of Patent: May 15, 2001

(54) METHOD AND APPARATUS FOR INTERCONNECTING SPACERS

(76) Inventors: Johan Welleman, Bastustigen 18, SE-546 33 Karlsborg; Sven Welleman, Perstorp, SE-543 94 Tibro, both of (SE)

( * ) Notice: Subject to any disclaimer, the term of this patent is extended or adjusted under 35 U.S.C. 154(b) by 0 days.

(21) Appl. No.: 09/308,845

(22) PCT Filed: Dec. 2, 1997

(86) PCT No.: PCT/SE97/02014

§ 371 Date: May 24, 1999

§ 102(e) Date: May 24, 1999

(87) PCT Pub. No.: WO98/24700

PCT Pub. Date: Jun. 11, 1998

(30) Foreign Application Priority Data

Dec. 2, 1996 (SE) ..... 9604417

(51) Int. Cl.[7] ..... B21D 39/03

(52) U.S. Cl. ..... 29/430; 24/288; 108/901; 53/589; 100/26

(58) Field of Search ..... 29/430; 206/386, 206/596, 599; 108/901, 90, 51.11; 53/589, 339; 100/26

(56) References Cited

U.S. PATENT DOCUMENTS 4,225,259 * 9/1980 Baldwin et al. ..... 403/62
4,545,482 * 10/1985 Novatny ..... 206/320

FOREIGN PATENT DOCUMENTS 8804263 6/1988 (WO) .

* cited by examiner

*Primary Examiner*—David P. Bryant
*Assistant Examiner*—John C. Hong
(74) *Attorney, Agent, or Firm*—Orum & Roth

(57) ABSTRACT

The invention relates to a method for providing releasable joining together of spacers in pairs which are preferably formed by support blocks for pallets or support walls on pallets or other load carriers by joining the spacers by means of flexible straps or by means of other releasable joining means, like pins or clamps. Spacers which are unattached or which already are integral building units in a respective pallet, are fed forward by means of a hauling track compressed in pairs to a joining station after which they are joined together and clamped together tightly. The invention is also related to machines for performing the method.

12 Claims, 8 Drawing Sheets

METHOD AND APPARATUS FOR INTERCONNECTING SPACERS

Figure 1:
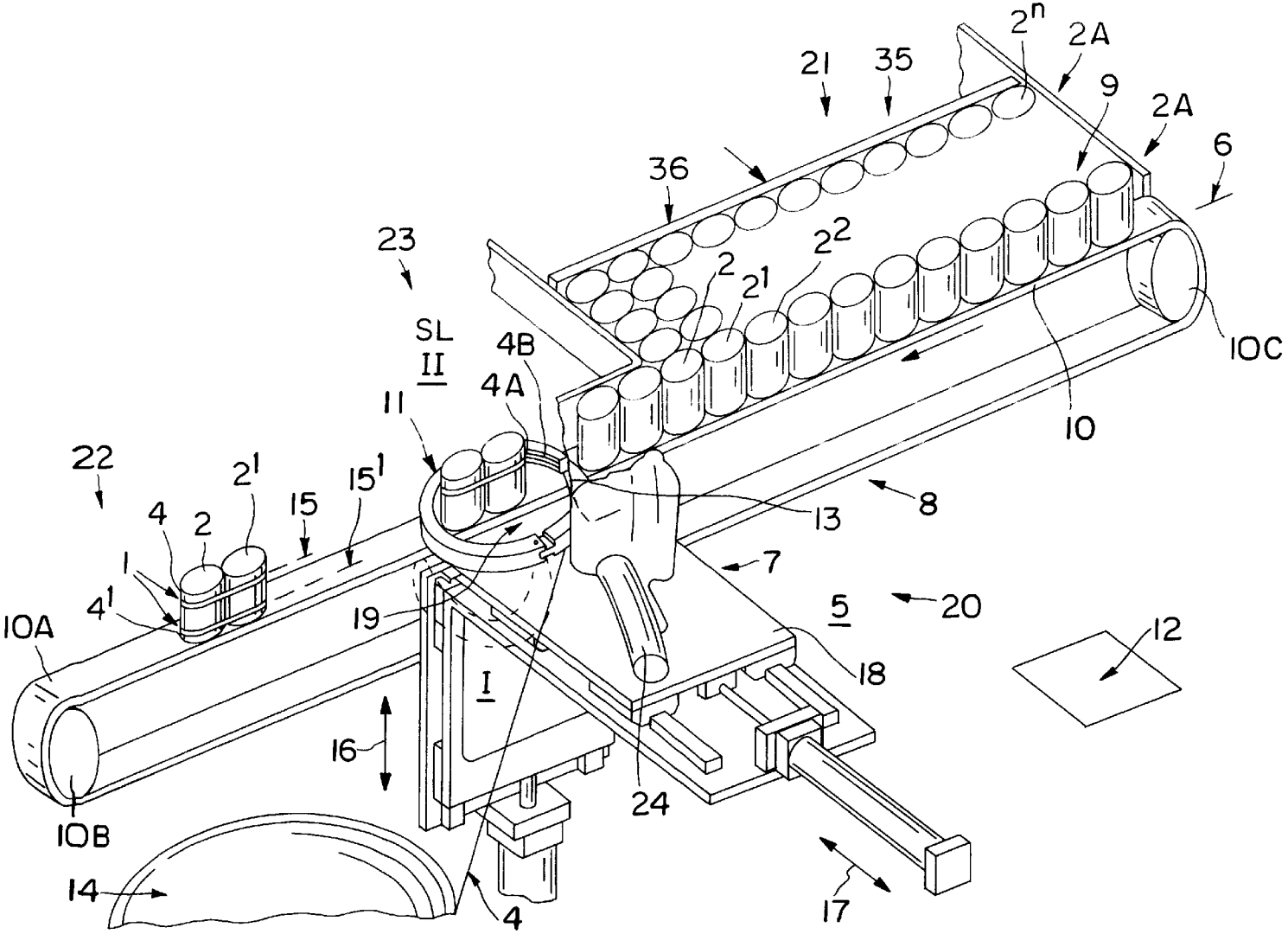

The present invention relates to a method for providing detachable joining together of spacers in pairs, preferably formed by support blocks for pallets or support walls in pallets or other load carriers by joining together said spacers by means of flexible straps.

Present handling and distribution of goods is nowadays largely performed in such a way that producers package goods directly upon a so called sub-pallet, e.g. in standard size 800×600 mm, which after film wrapping or other type of wrapping is placed in pairs on a so called full size pallet, which thereby forms a so called slave pallet. Everything is stored and is later distributed as a common unit for users, e.g. wholesalers or shops. This system involves important disadvantages such as being work intensive, time consuming and space consuming in warehouses and also is cargo space lost in all handling and transporting links for the pallet i.e. during storage, distribution and return.

Above all, within the everyday commodities trade, goods are today packed on so called semi pallets in the size 600×800 mm, but in e.g. the printing industry combined part pallets are used in varying sizes. Other more or less often frequent fixed part pallet formats are e.g. quarter pallets 600×400 and a third pallet 400×800 mm, while a so called full size pallet has EUR size 800×1200 mm. Such pallet part formats are used according to what is considered to be especially suitable in the respective line of business in order to enable and facilitate a flexible and efficient local handling. On the other hand, all faraway handling is performed with respectively on full size pallets, for which all handling and storage apparatus like cargo trucks, fork lift trucks, pallet scaffoldings and so on are dimensioned and otherwise adapted for.

In order to clear the transition between pallet part format half size pallet 800×600, quarter size pallet 600×400 and third size pallet 400×800 mm, so far so called slave pallets 800×1200 (full size pallets), have been used in accordance with the above described. In order to overcome this and other problems, applicant has in the European patent No. 0 334 881 proposed to hold together pallets by means of divisible holders which surround their spacer, e.g. metal or plastic straps. This manner of joining two or more pallets into a unit, has proven to be a key solution in order to overcome the above mentioned problem. There has so far not existed a method or device respectively for enabling, facilitating respectively a fully respectively semi automatic pallet respectively goods handling while using the proposal according to the above mentioned European patent.

A return system of pallets which are joined together sideways for forming larger pallets or other load carriers e.g. of plastic material requires rational joining methods and handling of pallets and/or therein included parts.

The main object of the present invention is therefore in the first hand to find a method which solves among other said problem efficiently and safely and which enables automatizing joining together part pallets or spacers for these.

The aforementioned object is achieved by means of a method according to the present invention, which is substantially characterized in that spacers are conveyed by means of a hauling track, said spacers being loose or already included as integral building units of a respective pallet, compressed in pairs to a station for joining, that the pairs of spacers are encompassed by means of a ring shaped preferably openable band guide along which said band is arranged to run until it forms a loop around the spacer, wherein they are joined together and clamped together tightly.

Another object of the present invention is to provide a machine for performing a method for producing releasable joining together of spacers in pairs, preferably formed by support blocks for pallets or support walls in pallets or other load carriers by joining together said spacers by means of releasable joining means in the form of flexible straps and with which the intended method may be performed efficiently.

The aforementioned further object is achieved by means of a machine according to the present invention which is substantially characterized in that it includes a hauling track for conveying spacers to a joining station along the hauling track for the spacers as well as a ring shaped preferably openable band guide along which said band is adapted to run until it forms a sling around the spacer.

Figure 2:
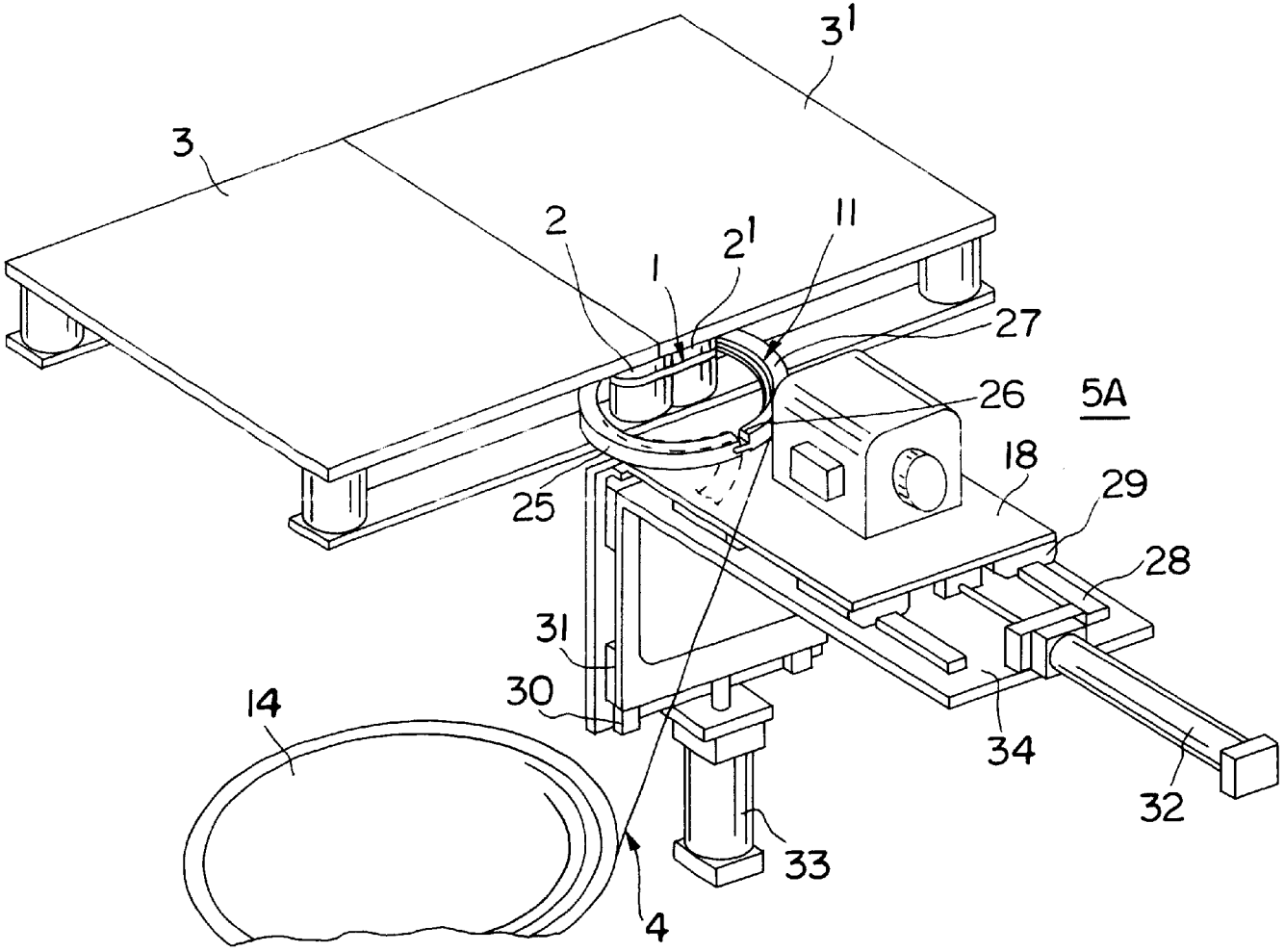
Figure 3:
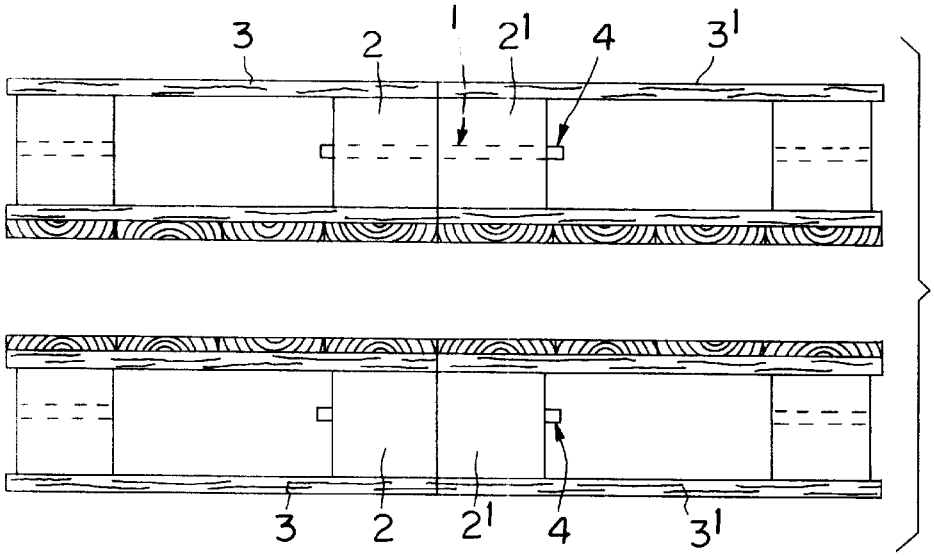
Figure 4:
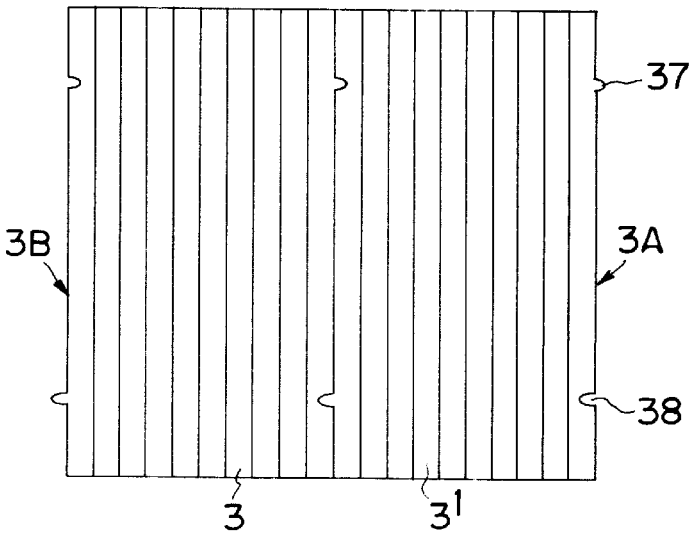
Figure 4A:
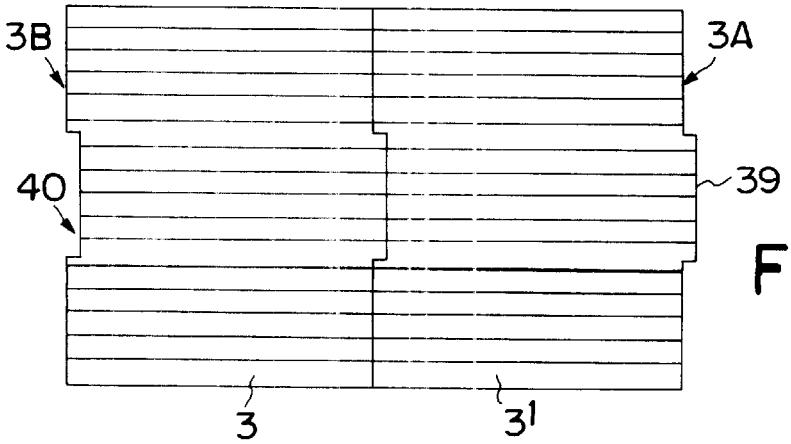
Figures 1, 5:
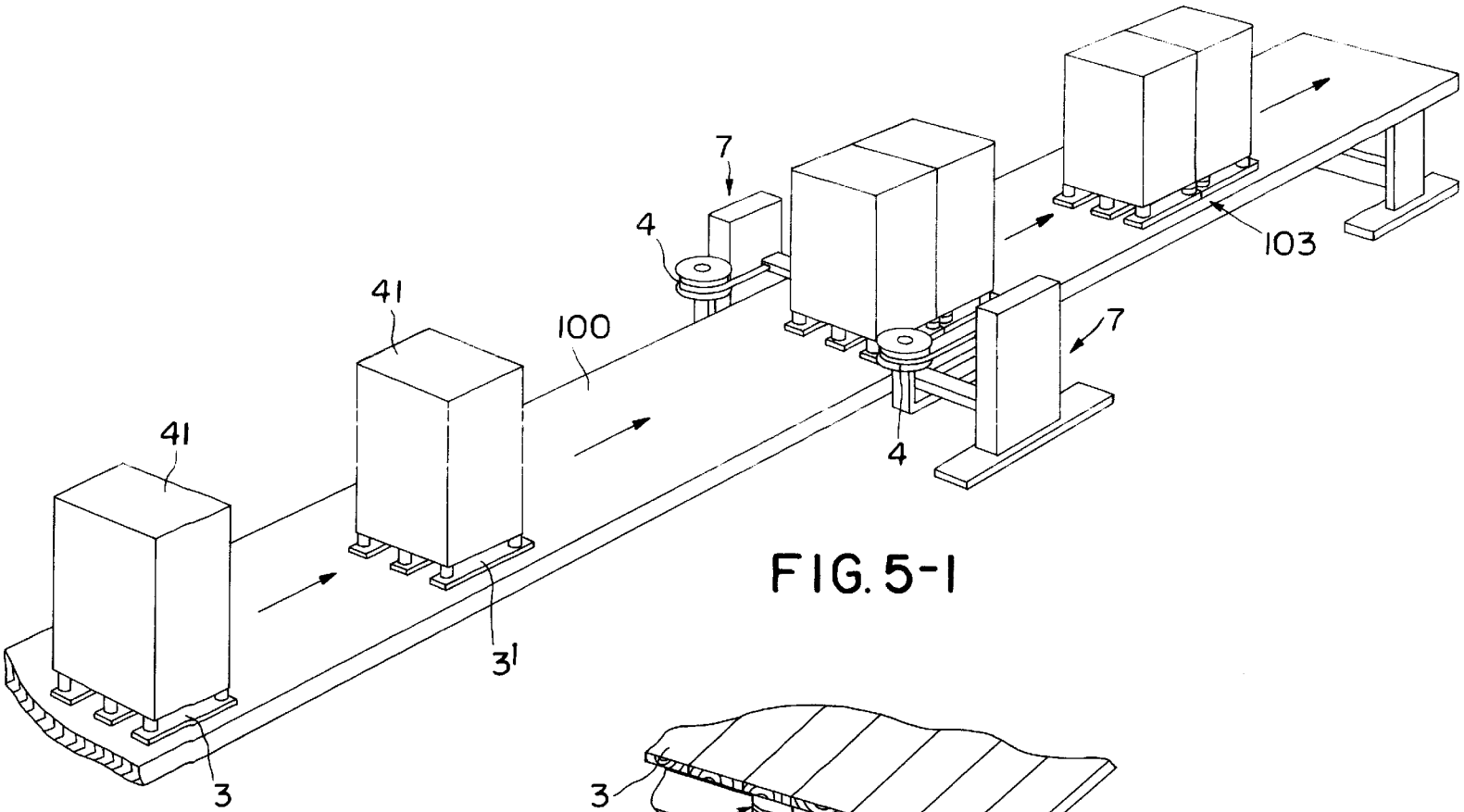
Figures 2, 5:
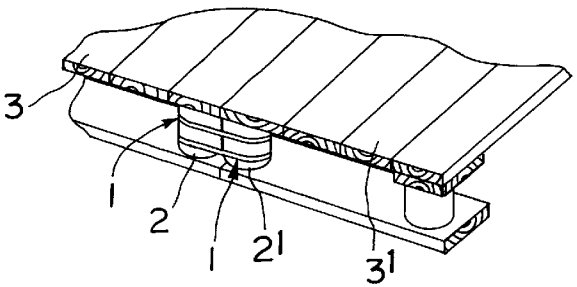
Figures 1, 5A:
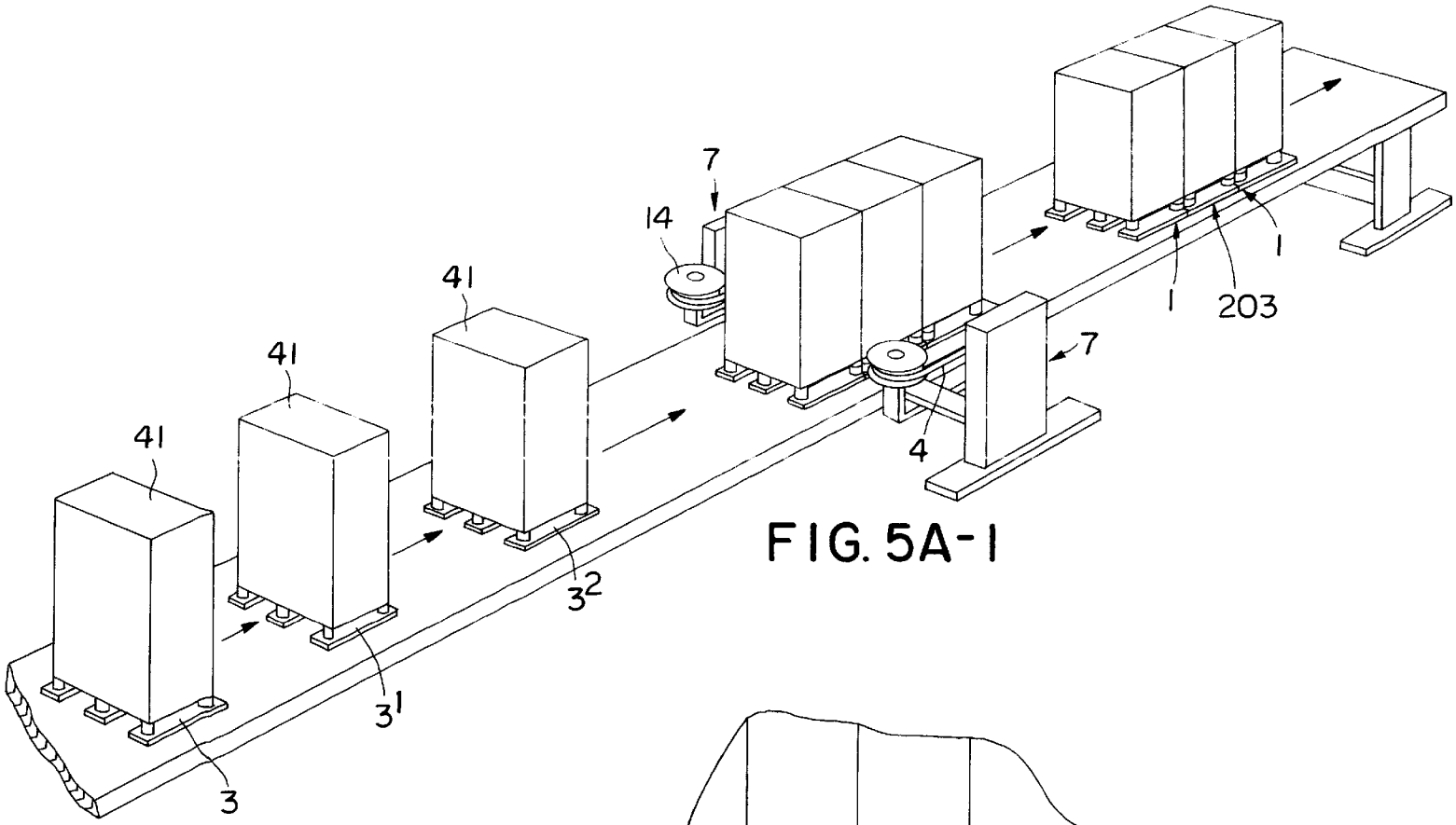
Figures 2, 5A:
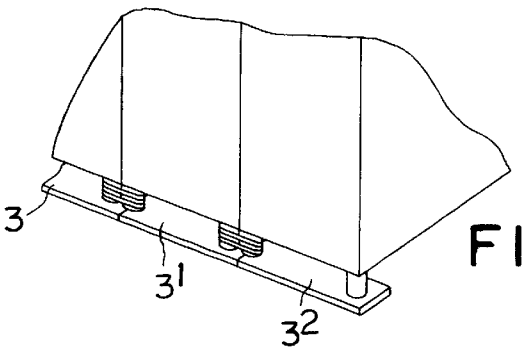
Figures 1, 2, 3, 5B:
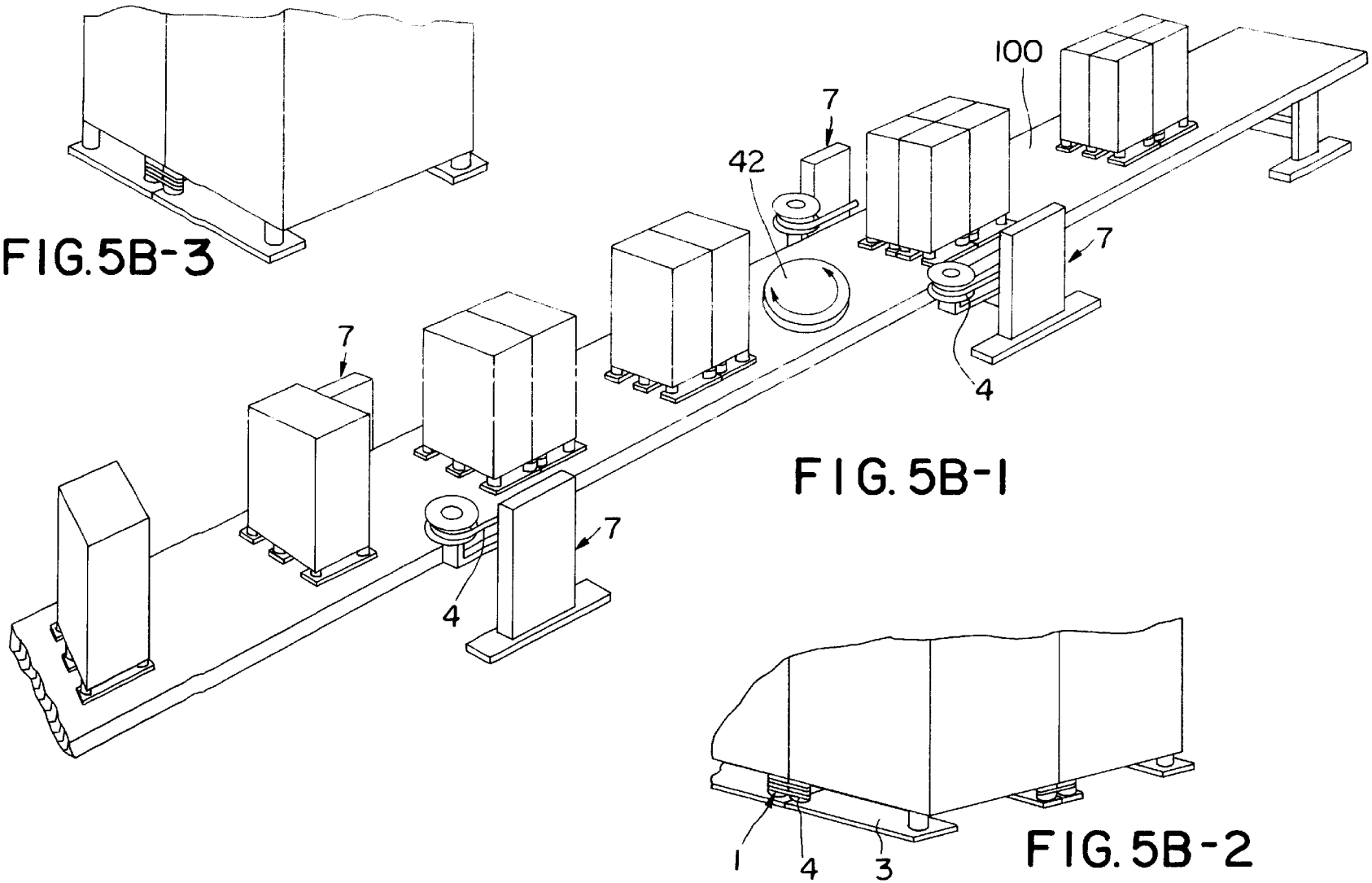
Figures 1, 5C:
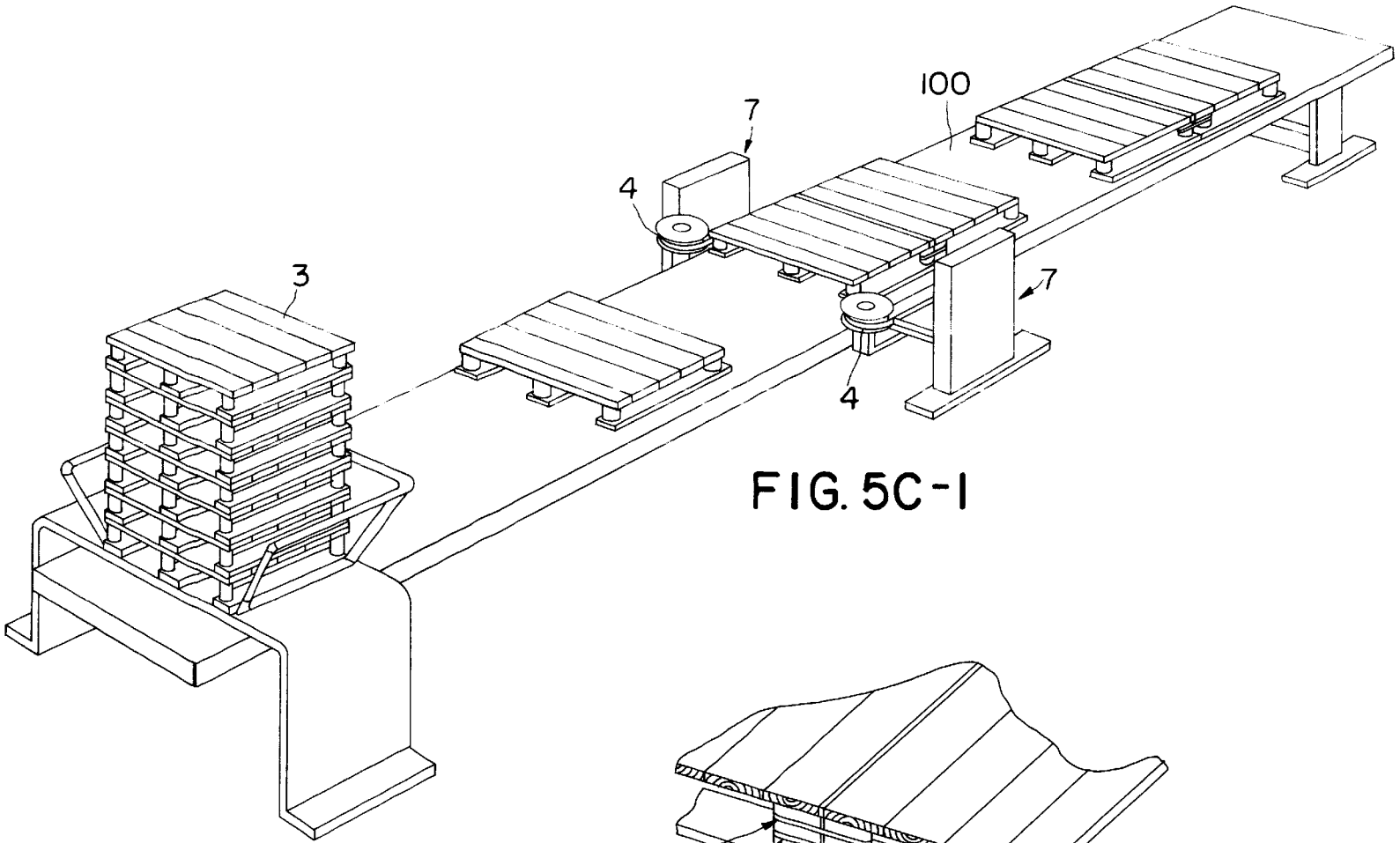
Figures 2, 5C:
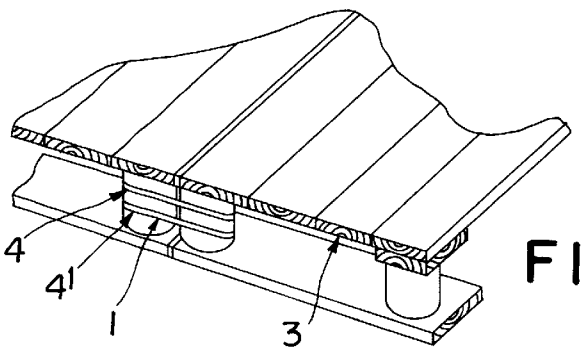
Figures 1, 2, 6:
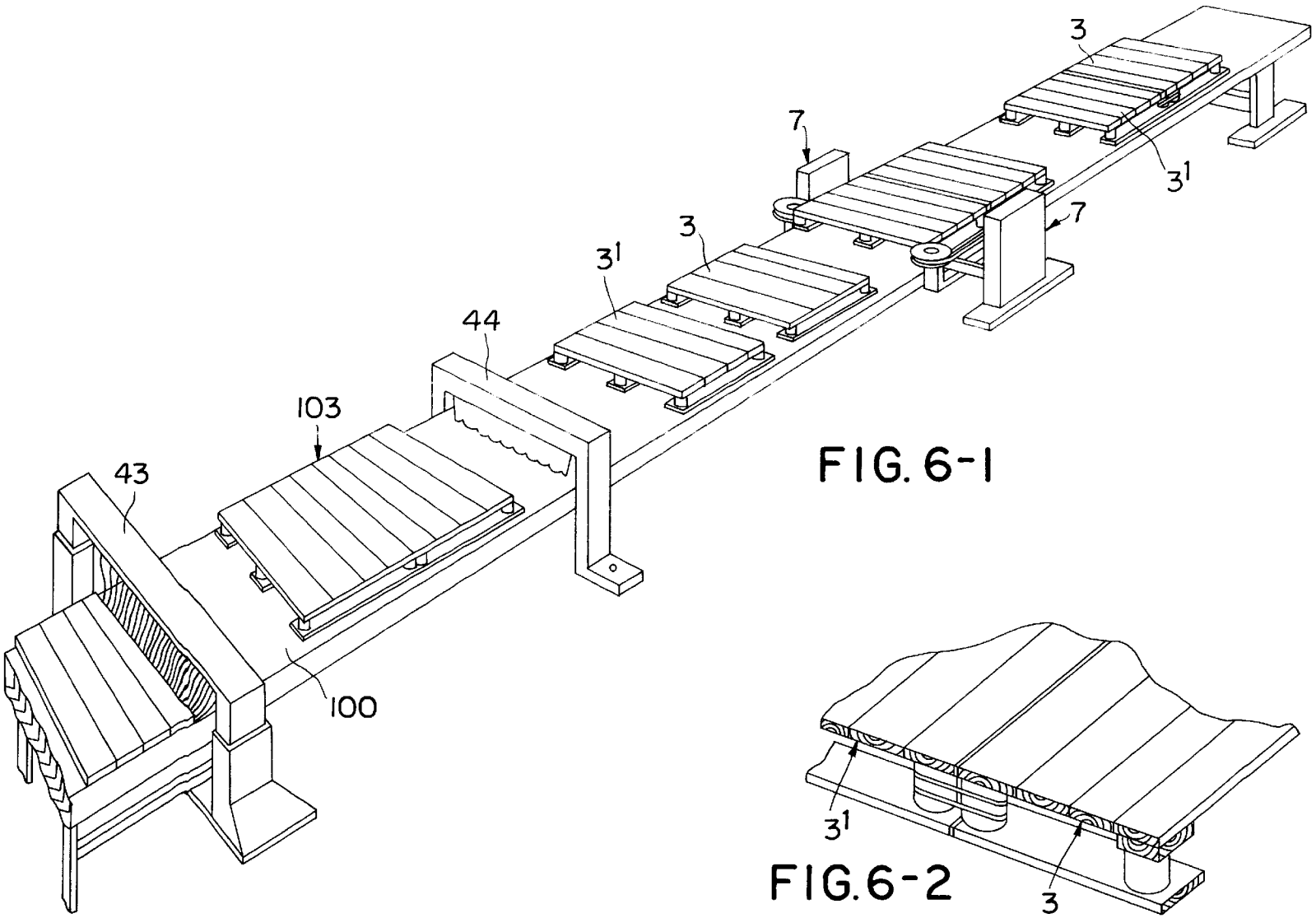

The invention will now be described in the following with reference to the accompanying drawings, in which FIG. 1 shows a schematic perspective view of a machine for joining unattached spacers for pallets with illustrated method for application of the machine, FIG. 2 shows a similar machine and its application for joining part pallets together via pallet spacers in pairs or distance walls in the pallet, FIG. 3 shows in a side view and an edge view respectively of the pallet formed by joining part pallets, FIG. 4 shows in a plane view a full pallet formed by joining two part pallets and by exhibiting dowel pin and hole element for joining together in order to achieve a locking function in both directions, FIG. 4A also shows in a plan view part pallets exhibiting sideways projecting coupling elements, FIGS. 5, 5A and 5B shows schematically automatic conveyors and joining machines which are for automatic packaging of part pallets with goods, FIG. 5C shows schematically a transporter and a joining machine for returned unloaded (empty) part pallets joined into a full pallet, which creates alternative prospects for producers to be able to get different variants of part pallets joined into a ready full pallet, and which gives large advantages and profits for the producers to be able to receive alternative opportunities, and FIG. 6 shows a fully automatic machine line for production of divisible pallets and joining of part pallets respectively for making full pallets.

By means of the new opportunity for joining returned unloaded part pallets into full pallets, production and wrapping may be done directly by these with considerable cost savings as result.

The invention is strongly aimed at the future because the need for smaller pallet sizes is strongly growing. Thereby, e.g. also neighbourhood shops may get satisfactory turnover within a minimum of selling area. At the same time as wholesale trade may maintain an efficient form of distribution.

Return systems according to the invention means that producers now may pack and distribute part pallets joined together without slave pallet or using the new alternative possibilities which are enabled by FIG. 5C.

When part pallets are packed, these go on further on the transport conveyor to a joining station, so on both sides joins part pallets to a full pallet.

joining takes place fully automatic from both sides via machine with strapping in alternatively plastic band or steel band. Alternatively, joining may occur by means of clamp or locking pin.

When the full pallet with joining of two half pallets will reach the end user, wholesaler or shop, division takes place in accordance with the following:

for plastic band or steel straps, the straps are quickly and easily cut off. The bands go to recycling. The pallets go in return to the same producers, that reuse the pallets and repack in the same way with new strapping or joining. New plastic straps or steel straps are used during re-strapping.

for clamp or locking pin, the division takes place with a special tool. The clamp or the locking pin goes in return to the producers as well as the part pallets.

Advantages return system:

Lighter, easier and quicker for the end user, wholesaler or shop to distribute and handle half pallets and small pallets.

The full pallet (slave pallet) is saved, i.e. the pallet which carries the part pallets in all stages i.e. in production, store, distribution and during all handling.

Much lower costs when the full pallet (slave pallet) is taken away. About 15 cm space is saved for every unit at each storing and transport of part pallets in height.

Much lower costs for distribution and handling. No return cost for the full pallet (slave pallet).

Return of pallets and other accessories leads to large environment gains.

Conveyors and machines for joining creates:

New rational packing and handling,

Large time-savings,

Manual lifting disappears (heavy manual lifting by part pallets on slave pallet), Large ergonomic improvements, Much better work environment-total environment.

According to the present invention, a method for providing detachable joining by means of a detachable joint 1A of in pairs tightly together held spacers 2, 2$^1$, which preferably are formed by support blocks for pallets 3, 3$^1$ in pairs, or support walls in pallets or other load carriers, by joining aforementioned spacers 2, 2$^1$, by means of flexible bands 4 or by means of other suitable detachable joining means for this purpose, like e.g. pins or clamps, an automated method. More exactly, a hauling track 10 conveys aforementioned spacers 2, 2$^1$ sideways, which are unattached as is shown e.g. in FIG. 1, or that already are integral building units or side walls of each divided pallet 3, 3$^1$, or other load carrier e.g. platform, container, etc. to a joining station 5A packed together tightly in pairs at a common level 6. Then the aforementioned spacers 2, 2$^1$, are joined together in pairs by means of suitable joining means 4 and are clamped together tightly.

The above described joining is arranged to be performed fully automatic and is described in the following is only described bands 4 as external joining means and which are in the manner of a sling brought to surround and enclose said pair of spacers 2, 2$^1$, in a strapping machine 7, which is located at the side 8 of a feeding line 9 for at least spacers 2, 2$^1$. Then follows mutual joining of band ends 4A, 4B, for forming a divisible strap 1 which encloses said spacers 2, 2$^1$ in pairs.

The aforementioned pairs of spacers 2, 2$^1$ are enclosed by a ring shaped preferably openable band guide 11 along a substantially horizontal plane 12 and along which band guide 11 said band 4 is arranged to run until forming a sling around the spacer 2, 2$^1$.

The shown example relates to a method where band 4 consisting of metal is used and lead seals 13 or other coupling elements are used for threading onto the band 4 which is supplied continuously from a band magazine 14.

In order to provide efficient joining of spacers 2, 2$^1$, with each other so that these which for example are formed by blocks of e.g. compressed fibre material with preferably circular cross section, do not risk gliding apart from each other or to be tilted due to incomplete joining with each other, is now suggested that you join the spacers 2, 2$^1$, to each other at different levels 15, 15$^1$. Therefore, the strapping station 5 is moved vertically with reference to the spacers 2, 2$^1$, between different levels 15, 15$^1$, in order to be able to tighten the bands 4, 4$^1$, on in pairs compressed spacers 2, 2$^1$. The aforementioned strapping station 5, which includes a table 18 which may be elevated vertically 16 and sideways 17 perpendicular to the hauling track 10 displaceable, and which carries a said band guide device 11, is arranged to move between a retracted pass position I, shown in dashed lines in FIG. 1, in order for the spacer 2, 2$^1$, to be able to be received in it, and a forward moved strapping position II, shown with continuous lines in FIG. 1, and respectively able to be elevated between at least two levels, in order to be able to insert the spacer 2, 2$^1$, into the internal cavity 19 of the band guide device and to be able to locate the bands 4, 4$^1$, at the desired level 15, 15$^1$.

A machine 20 for performing an above described method for strapping etc. of spacers 2, 2$^1$, in pairs in accordance with the above, comprises a hauling track 10, e.g. a conveyor band 10A which runs between rollers 10B, 10C in pairs from a magazine 21 with loose spacers 2, 2$^1$, 2$^2$ . . . 2$^n$ and to an outfeed station 22 via a joining station 23 between these along the hauling track 10 for the spacers 2–2$^n$.

The machine 20 is arranged to function as an automatic machine for both feeding the spacers 2–2$^n$ forward to a stop position SL in front of the band guide device 11 and subsequent binding by means of bands 4, that are adapted to be fed forward continuously by means of drive means 24 for this purpose from a band roll 14, to a strapping machine 7 which is positioned sideways displaced from said hauling track 10.

The band guide 11, which is designed as a combined band guide and strapping unit, is openable via a arched semi circle shaped aperture segment 25, which is articulated 26 connected to an also arched semi circle shaped frame segment 27, which may pivot around said joint 26 between a closed strapping position and an open position respectively, dash dotted line, for passing the spacer 2, 2$^1$, through the band guide 11.

The aforementioned binding unit 11 and the remaining parts of the strapping machine 7 are supported by a machine table la, which is journalled via guideways 28, 29; 30, 31 sideways displaceable 17 actuated by a preferably hydraulic alternatively pneumatic cylinder or other jack 32, and elevating vertically 16 by means of a preferably hydraulic alternatively pneumatic cylinder or other kind of elevating jack 33, which supports a table frame 34 which may be angled between horizontal and vertical position.

The hauling track may also be formed by for example a conveyor band adapted for receiving pallets 3, 3$^1$, on it and which runs between a loading station for pallets 3, 3$^1$, and an out feed member for banded pallets 3, 3$^1$, or spacers 2, 2$^1$, e.g. for joining quarto and/or semi pallets for forming a full pallet with interconnected spacers which abut each other.

Stating more precisely, an automatic machine for strapping by means of steel bands of spacers in form of pallet support blocks 2–2$^n$, comprises the following parts and method described running:

The pallet blocks 2–2$^n$ are delivered stacked on a standard pallet with a rigid sheet between each layer (about 150 in each layer). The machine automatically feeds pallet blocks 2–2$^n$ in pairs to the strapping station and further to transport wrapping alternatively that stacking on pallet is performed manually.

The fundamental construction of the machine is clear from the accompanying drawings and comprise the following components:

Lifting table 35 for pallet, ejector 36 which step by step pushes a series 2A of pallet blocks from pallet to the hauling track 10, hauling track 10 which continuously feeds pallet blocks, stopping and separation unit for feeding pallet blocks 2, 2$^1$ in pairs to a strapping station, stopping and clamping unit, orientation and feeding unit for lead seals 13 e.g. a vibration feeder, band guide 11 for the band end 4A, slide unit which performs the movement vertically and sideways, supplemented by band guide mechanism and pneumatic clamp and riveting tool and, strip coiler.

Functional description of the machine is according to the following:

All units are in initial position for automatic start. The lifting table will pallet is raised to the correct level with reference to the hauling track., wherein:

I A pusher 36 steps a series of 2A pallet blocks forward to the hauling track 10 and works continuously until the pallet blocks are consumed.

II The hauling track 10 feeds the pallet blocks, forward to a stop.

III Two pallet blocks 2, 2$^1$ are separated.

IV The hauling track 10 feeds these forward to stops in the strapping station.

V The pallet blocks are clamped.

VI The slide unit feeds forward sideways.

VII The band guide closes and a lead seal is fed forward to the band guide.

VIII The feeding of steel band 4 is made a full lap through lead seal twice.

IX The band end is bent.

X The steel band is stretched.

XI The steel band 4 is riveted and cut off. and

XII The slide unit is elevated vertically to a new strapping position.

XIII Then strapping is performed in accordance with above but at another level.

XIV The band guide is opened after performed strapping. The slide unit is moved vertically to the original strapping position, whereupon the slide unit is backed sideways. Release of stop and clamping, and the finished detail is fed out.

The cycle is repeated until its pallet blocks are used up at the store, whereupon this sheet is lifted away and the lifting table is elevated to another level.

In FIGS. 4 and 4A is shown two interconnected pallets 3, 3$^1$, which exhibit coupling aids consisting of male and female e.g. dowel-hole 37, 38 or strip-aperture 39, 40 respectively which cooperate in pairs with each other along adjacent and interconnected pallet sides 3A, 3B. Said coupling means among other functions as stabilizing aids in connected position. Also the spacer may be provided with similar aids for stabilizing in both the vertical as well as the horizontal direction.

The machine system in accordance with the invention is flexible adapted for joining return pallets and disposable pallets.

Return pallets:

Moulded of plastic material. Constructed with male- and female construction which provides extra locking, binding and reinforcement between the pallet units. The pallets are returned and reused for new joining.

Manufactured from aluminium or galvanized steel material. Constructed with male- and female construction which provides extra locking, binding and reinforcement between the pallet units. The pallets are returned and reused in new joining at the producers.

Disposable pallets:.

Manufactured from wood and or chip/board/plastic material. After use, the pallets are recycled.

Joining takes place fully automatic in machine-system.

The joining machines are located at both sides of the machine line simultaneously perform the steps of joining.

The joining may be made with different alternative methods:

Steel band with lead seals or welding,

Plastic band with locking lead seals or welding,

Locking pin

Clamp etc.

When the full pallet with the joined small pallets arrive at the end user, wholesale dealer or shop, division takes place according to the following: The steel band or the plastic band is rapidly cut off and easily removed. The bands are recycled. Locking pin or clamp is removed and are returned for reuse for new joining at the producers.

In FIG. 5 is shown two with goods 41 provided half pallets 3, 3$^1$, which are on the way to the strapping machine 7. When the first part pallet 3$^1$ has reached the machine 7 it stops, for example by lifting by means of not shown holding means a small distance above the means of transport 100. When the other semi pallet 3 has reached the first, stationary part pallet 3$^1$ the transport means 100 and the first part pallet are lowered down to the transport means 100. Alternatively, the first part pallet 3$^1$, is allowed to slip on the transport means 100 until the other part pallet 3 has reached the first. Additional ways are naturally possible, especially feeding of semi pallets onto the transport means 100 in the form of intended units, which then are stopped at the joining station. Then the strapping machine 7 is activated, one at each side of the transport means 100, and holds the two part: pallets 3, 3$^1$, together, e.g. by surrounding the adjacent distance blocks 2, 2$^1$, of the part pallets with steel and/or plastic bands 4. Then the transport means 100 is again applied for feeding a thus formed divisible full pallet 103 to the feed out end and to further handling and division.

In FIG. 5A is shown a rather like method and a device respectively, where however three part pallets 3, 3$^1$, 3$^2$, with goods 41 are brought together for forming a full pallet 203.

In FIG. 5B is principally shown quart pallets, which in a first joining and holding station respectively are united into a pair. Two such pairs are brought together and are then fixed in a second joining and fixing station respectively into an intended unit comprising four part pallets. On the way to the second station, there is a turning station 42, which turns each fed pair 90 degrees, after which it is fed forward to the other joining and fixing station respectively. Preferably, the transport means 100 is divided into two parts, one before and one after the turning station 42.

In FIG. 5C is first of all shown return part pallets 3 and so on e.g. of plastic, which are fed onto the transport means and handled further on in accordance with FIG. 5, 5A or 5B.

In FIG. 6 is first of all illustrated the production of wood pallets 3. Nailing together work pieces and blocks 2, 2$^1$, to a completed full pallet 103 takes place in a fully automatic pallet nailing machine 43. Flexible formats may occur in length, width and height.

The assembled full pallet 103 is automatically forwarded via transport means 100 into a saw cutting machine 44 which automatically saws and divides the full pallet 103 into two or more smaller part units 3, 3[1].

After sawing through and dividing via the transport means 100, the part pallets 3 3[1], move into a joining machine 7 where joining takes place to a ready assembled 1 divisible full pallet 103.

The advantage with this is method is that the part pallets will be more even and exact in their dimensioning and therefore fits better together at the subsequent joining and gets an exact and safe joining.

The invention is not limited to the above described and in the drawings shown embodiments but may be varied within the frame of the claims without departing from the inventive concept.

What is claimed is:

1. A method for providing detachable joining together of spacers which are formed by support blocks for pallets, comprising the steps of:

a) conveying compressed pairs of spacers, which are unattached or already are integral units of respective pallets, with a hauling track, to a station for joining;

b) encompassing a respective pair of spacers with a ring shaped openable band guide;

c) directing a flexible strap through said band guide until it formed a loop around the pair of spacers; and d) joining and clamping said pair of spacers together tightly with the flexible strap.

2. A method according to claim 1, further comprising the step of:

connecting the ends of the flexible strap with each other for forming a divisible joining sling which encloses said pair of spacers. .

3. A method according to claim 2, wherein step a) comprises transporting said spacers to a strapping station .

4. A method according to claim 2, wherein the step of connecting the ends of the flexible strap together comprises joining the ends of a plastic strap by lead seals or, by welding or riveting the ends of steel straps .

5. A method according to claim 2, further comprising the step of:

supplying lead seals for threading onto the flexible strap which is supplied continuously from a band magazine.

6. A method according to claim 1, further comprising moving the joining station vertically with reference to the pair of spacers in order to compress the pair of spacers.

7. A method according to claim 6, wherein the joining station comprises a table which can be elevated vertically and is displaceable sideways, the table supporting said band guide and being arranged to be displaced between a retracted position and a forward position.

8. A machine for providing detachable joining together of spacers, which are formed by support blocks for pallets, in pairs by means of a flexible strap comprising, a hauling track for conveying pairs of spacers, a joining station along the hauling track for joining the spacers, the joining station including a ring shaped openable band guide along which said strap is arranged to run until it forms a sling around a respective pairs of spacers.

9. A machine according to claim 8, further comprising a strapping machine at said joining station, said strapping machine disposed laterally adjacent said hauling track and including said ring shaped band guide, and wherein said hauling track automatically feeds pairs of spacers forward to a stop position at said ring shaped band guide, and said strapping machine subsequently straps a respective pair of spacers together.

10. A machine according to claim 9, wherein said ring shaped band guide of said strapping machine includes an articulated section, which is pivotable between an open position to permit a pair of spacers to be fed into said ring shaped band guide and a closed strapping position.

11. A machine according to claim 10, wherein said strapping machine is mounted to a machine table which is horizontally displaceable toward and away from said hauling track by a first jack and vertically displaceable with respect to said hauling track by a second jack.

12. A machine according to claim 8, wherein said hauling track comprises a belt conveyor which runs between a loading station for spacers and an outfeed end for strapped spacers.

* * * * *